US008870038B2

(12) United States Patent
Nyambi et al.

(10) Patent No.: US 8,870,038 B2
(45) Date of Patent: Oct. 28, 2014

(54) PUSH-BUTTON DISPENSER FOR BOTTLES WITH CARBONATED BEVERAGES

(75) Inventors: Samuel O. Nyambi, Marietta, GA (US); Fritz Seelhofer, Lindau (CH)

(73) Assignee: The Coca-Cola Company, Atlanta, GA (US)

( * ) Notice: Subject to any disclaimer, the term of this patent is extended or adjusted under 35 U.S.C. 154(b) by 179 days.

(21) Appl. No.: 13/643,454

(22) PCT Filed: Apr. 26, 2011

(86) PCT No.: PCT/EP2011/056522

§ 371 (c)(1),
(2), (4) Date: Jan. 2, 2013

(87) PCT Pub. No.: WO2011/134928

PCT Pub. Date: Nov. 3, 2011

(65) Prior Publication Data

US 2013/0092712 A1 Apr. 18, 2013

(30) Foreign Application Priority Data

Apr. 28, 2010 (CH) ..... 625/10

(51) Int. Cl.

| | |
|---|---|
| ***B67D 7/78*** | (2010.01) |
| ***B65D 83/32*** | (2006.01) |
| ***B65D 83/44*** | (2006.01) |
| ***B65D 47/10*** | (2006.01) |
| ***B67D 1/04*** | (2006.01) |

(52) U.S. Cl.

CPC ..... *B65D 47/103* (2013.01); *B65D 83/32* (2013.01); *B65D 83/44* (2013.01); *B67D 1/0456* (2013.01)

USPC ..... 222/464.1; 222/399; 222/204

(58) Field of Classification Search

CPC .. B65D 47/103; B67D 1/0425; B67D 1/0456; B67D 1/0802; B67D 7/72; B67D 2001/0824; B67D 2001/0825

USPC ..... 222/146.1, 146.3, 146.6, 394–399, 204, 222/216, 464.1

See application file for complete search history.

(56) References Cited

U.S. PATENT DOCUMENTS

| | | | | |
|---|---|---|---|---|
| 4,154,378 | A | 5/1979 | Maurelli | |
| 4,286,636 | A * | 9/1981 | Credle | 141/114 |
| 4,671,436 | A * | 6/1987 | Hagan | 222/402.25 |
| 4,995,534 | A * | 2/1991 | Norman | 222/511 |
| 5,518,151 | A * | 5/1996 | Knickerbocker | 222/382 |
| 5,520,310 | A | 5/1996 | Bauer | |
| 6,253,965 | B1 * | 7/2001 | Pitocco | 222/153.07 |
| 8,191,740 | B2 * | 6/2012 | Hoss et al. | 222/399 |
| 2005/0252936 | A1 | 11/2005 | Finlay | |

FOREIGN PATENT DOCUMENTS

| | | |
|---|---|---|
| EP | 0133770 | 3/1985 |
| EP | 0583825 | 2/1994 |

OTHER PUBLICATIONS

Search Report for corresponding international application, PCT/EP2011/056522, issued Nov. 24, 2011.

* cited by examiner

*Primary Examiner* — Lien Ngo
(74) *Attorney, Agent, or Firm* — King & Spalding

(57) ABSTRACT

The push-button dispenser for bottles with carbonated beverages as a head (1) which can be screwed onto a bottle and has a lateral pouring channel (15) and a push-button (16) on its upper side. A suction tube (10) projects downwards, this tube being intended to extend down as far as the base of the bottle (20) to be fitted with the dispenser. This suction tube opens out at the top into a valve device in the head (1), this valve device having a regulating means (5) which can be moved axially in relation to the bottle (20) and is biased in the closing direction by a spring (3). In order for the regulating means to be opened, pressure is applied to the push-button (16) from above, and therefore the pressure in the interior of the suction tube (10) is reduced to ambient pressure. This causes liquid to be expelled from the bottle, by way of the internal pressure prevailing in the bottle, out of the lower mouth opening of the suction tube (10) via the pouring channel (15). As a special feature, the suction tube (10) is produced from an elastomeric plastics material and its outer cross section and inner cross section are configured such that, with the internal pressure reduced to ambient pressure, in relation to the increased pressure prevailing from outside, it can have its throughflow cross section narrowed by deformation. This means that, despite the pressure in the bottle gradually decreasing, the amount of liquid which flows out per unit of time is kept more or less constant. The push-button dispenser makes it possible for bottles with carbonated beverages to be, for all practical purposes, completely emptied in an extremely convenient and reliable manner, in the upright or even horizontal position, just at the push of a button.

13 Claims, 9 Drawing Sheets

Flow rate

Pressure, Pa

PUSH-BUTTON DISPENSER FOR BOTTLES WITH CARBONATED BEVERAGES

RELATED APPLICATIONS

Figure 1:
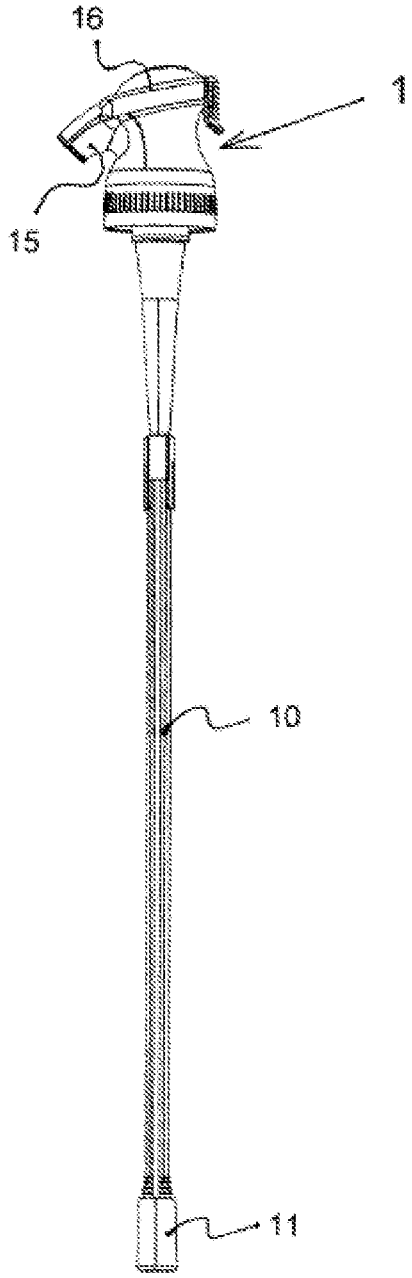

This application is a national phase application of international application number PCT/EP2011/056522, titled "Push-Button Dispenser For Bottles With Carbonated Beverages," filed on Apr. 26, 2011, which claims priority to Swiss patent application number 625/10 filed on Apr. 28, 2010. The present application claims priority to the foregoing applications and incorporates herein by reference in their entirety the content of the foregoing applications.

This invention relates to a dispenser to dispense a carbonated beverage from a bottle by means of a simple pushbutton, regardless of whether the bottle is upright or horizontal.

Carbonated beverages are sold in very great quantities in glass and PET bottles as well as aluminum cans. Many millions of such bottles are opened daily and their content is poured out and drunk. The carbon dioxide in the drink, which imparts freshness to it, causes a rise in pressure in the bottle due to its outgassing. Everyone is familiar with the pffffft-sound that is heard when such a bottle is opened, because initially a certain excess pressure in the bottle is escaping. Bottles are marketed in various sizes, from 0.33 liter, 0.5, 1, 1.5, 2 liters content up to 3-liter bottles. However, the larger bottles are difficult for some people to manipulate. Especially small children as well as weak or elderly persons experience difficulties when handling heavy bottles. The bottles are often stored in a refrigerator and if a drink is wanted, then the bottle must be taken out of the refrigerator, opened, raised for pouring and tipped over a drinking glass, and then put back into the refrigerator. These procedural steps can be difficult to impossible for small children or weak adults, such as ill, elderly or handicapped persons. Initial opening of the threaded closure, which is in addition provided with a seal that has to be broken when opened, requires a force to be expended of which not all are capable. Additionally, repeated openings and closings of such a bottle causes part of the carbon dioxide to escape, so that the beverage becomes flat and lacking in fizz before it is completely consumed.

To avoid these problems, various devices have been proposed which can be mounted on the bottle's neck, to maintain the pressure in the bottle, and, if desired, to dispense carbonated beverages from the bottle always in a fresh condition, without having to deal with escape of carbon dioxide. For example, Belgian patent 743,485 discloses a device with a dispensing valve and a separate carbon dioxide valve, to add carbon dioxide to the bottle when its inner pressure drops below a certain level. According to Austrian patent 144,111 and U.S. Pat. No. 3,976,221, a pressure regulator is disclosed to regulate the carbon dioxide pressure in the beverage. But it is not only the pressure drop when dispensing carbonated contents of bottles, which as a rule hampers complete emptying, that is a problem. If a carbonated beverage is poured out, it tends to foam. This foaming is desired to a certain extent and indicates the beverage is fresh. However, excess foaming is not desired, because it prevents a drinking glass from being filled for an appreciable time. In addition, the longer the bottle has to remain open, the more carbon dioxide escapes, and the sooner the beverage in it becomes flat and lacking in fizz. Any turbulence of the beverage when it is dispensed, and any non-laminar flow, contributes to foaming. In addition, the ambient temperature plays a role. A cold carbonated beverage is more likely to foam, the warmer the ambient temperature is into which the beverage is released after reduction of the pressure. If the bottle is shaken previously, this promotes outgassing substantially and the problem of foaming becomes sufficiently serious that it becomes nearly impossible to properly dispense the contents of the bottle.

In the prior art various attempts to find solutions exist, to allegedly solve the problems named above. GB 2 219 988 discloses a dispenser which can be screwed onto a bottle. A small tube runs down to the bottom of the bottle. A manually operated, spring-loaded valve reduces the pressure in the neck by opening the compressed-together tube at a location quite close to the outlet, to dispense the beverage in controlled fashion from the bottle due to the increased inner pressure. The dispenser in addition includes a pressure regulator with a $CO_2$ compression cap, from which $CO_2$ is added if the inner pressure of the bottle drops below a certain level. However, this dispenser consists of a very large number of parts, including metal parts, and is correspondingly expensive to manufacture and assemble.

Although the basic principle of a dispenser is thus known in various embodiments, for dispensing a carbonated beverage by means of increased inner pressure in emptying the bottle through a controlled pressure reduction, the fact remains that in practice bottles of carbonated beverages are sold without such dispensers and these systems overall have not become established. There may be individual dispensers on the market that can subsequently be screwed onto a bottle. However, a considerable initial portion of carbon dioxide escapes due to the initial opening of the bottle, just to screw the dispenser onto the bottle. Also, such dispensers are very rarely used, if at all.

From the opposition proceedings for European patent 1 737 759 it can be gleaned that the following features already represent the prior art: a device for release of a fluid from a storage space of a container via at least one closeable release opening to the outside, with a pressure reservoir separated from the storage space, in which reservoir a propellant is admitted under pressure, with the reservoir able to be connected via a pressure regulator with the storage space. The pressure regulator exhibits an axially movable regulating means, which is acted upon by a pressurizing means, so that it is kept closed. The inner pressure acts upon the regulating means in the closing direction. The ambient pressure acts on the regulating means in the direction of its open position.

Thus a new dispenser cannot solely be concerned with the basic principle of the function which is previously known, but rather only a specific embodiment of such a dispenser and a specific implementation of this basic principle, so that it is implemented in technically better and simpler fashion, and overall a reliably functioning, mass-produced, easily operated, cost-effective dispenser is produced. All of this is the basic prerequisite for such a dispenser to have a chance to survive in the market.

Mindful of these previously-named circumstances, the task of the present invention is to provide a pushbutton dispenser for bottles with carbonated beverages which eliminates the problems mentioned above and at minimum meets the following requirements:

- The dispenser should make it possible to dispense the entirety of a bottle's contents, so that only a few drops are left, in any bottle position between upright and horizontal, into a drinking glass, purely due to the inner pressure generated by carbonation, simply by pushing a button.
- The dispenser should largely suppress foaming when dispensing, and offer a reasonable rate of outflow.

The dispenser should consist of a minimum number of parts and be easy to assemble, so that it is as cost-effective as possible in production.

The dispenser should have an opening seal which also prevents any dirt from getting into the outlet before the dispenser is opened by the customer.

The dispenser should make it possible comfortably to carry a bottle thus equipped suspended between two curved fingers.

The dispenser should be configured as a non-returnable dispenser and a mass-produced product, of combustible components, i.e. with no metallic parts.

This main problem is solved by a pushbutton dispenser for bottles with carbonated beverages with a head able to be screwed onto a bottle with a lateral pouring channel, a pushbutton on its top, and a suction tube projecting downwards, which is meant to reach down to the bottom of the bottle to be equipped, and which opens out at the top into a valve device in the head, which exhibits a regulating means able to be moved axially relative to the bottle, which is acted upon by a spring in the closing direction, and is able to be acted upon for opening from above manually with a pressing on the pushbutton, so that the pressure in the interior of the suction tube is able to be reduced to the ambient pressure, through which liquid can be expelled from the bottle through the inner pressure prevailing in the bottle from the lower mouth of the suction tube via the pouring channel, with this pushbutton dispenser characterized in that the suction tube is manufactured from a elastomeric plastic, and its outer and inner cross sections are so configured that with an inner pressure reduced to the ambient pressure it can be made narrow by deformation in its flow-through cross section in relation to the increased pressure prevailing from outside.

The additional problems are solved by a pushbutton dispenser with these above-mentioned features, if in addition, depending on the assignment, it exhibits still other specific features that are found in the dependent claims.

With the aid of the figures, such a pushbutton dispenser is depicted in an advantageous embodiment and subsequently these individual parts as well as the function of the pushbutton dispenser are described and clarified.

Shown are:

FIG. 1: The entire pushbutton dispenser in an assembled state and ready to be screwed onto a new filled bottle FIG. 2: The head with its individual parts in an assembled state FIG. 3: The pushbutton dispenser with all its component parts in an exploded view, and next to it, for size comparison, a bottle to be equipped with a pushbutton dispenser FIG. 4: The pushbutton dispenser with all its component parts in another exploded view, seen from another viewing angle FIG. 5: The head of the pushbutton dispenser seen in a longitudinal section FIG. 6: The suction tube in a perspective view, with the suction mouthpiece belonging to it FIG. 7: The preferred suction tube cross section at equal inner and outer pressure as well as next to it to the right with reduced pressure in the interior FIG. 8: A rectangular suction tube cross section at equal inner and outer pressure as well as next to it to the right with reduced pressure in the interior FIG. 9: A star-shaped suction tube cross section at equal inner and outer pressure as well as next to it to the right with reduced pressure in the interior FIG. 10: A dumbbell-shaped suction tube cross section at equal inner and outer pressure as well as next to it to the right with reduced pressure in the interior FIG. 11: A diagram of the measured flow rate in relation to the prevailing exterior pressure at inner atmospheric pressure FIG. 1 shows the complete pushbutton dispenser in an assembled state, ready to be screwed onto a new, filled bottle containing a beverage with carbon dioxide. The pushbutton dispenser consists of a head 1 and a suction tube 10 attached to its underside, which on the lower mouth ending is equipped with a mouthpiece 11. This is of an increased density, so that the suction tube 10, if the bottle is horizontal, is bent downwards in bowed fashion due to the weight of mouthpiece 11 and the mouthpiece 11 then comes to lie at the lowest place on the inner side of the horizontal bottle, so that liquid can always be removed by suction to the last.

Figure 2:
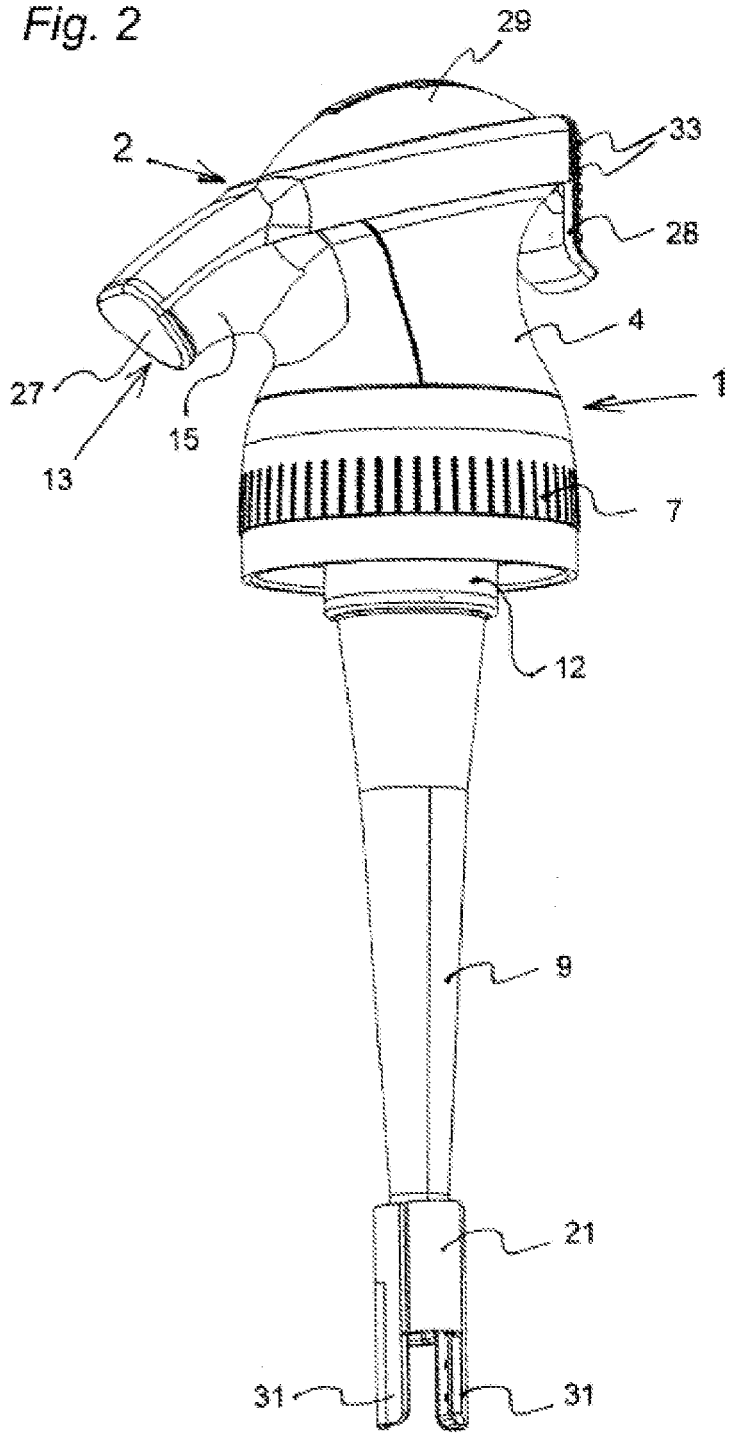

FIG. 2 shows the head 1 with its individual parts in an assembled state, but in an enlarged depiction. At the top is the pouring channel 15, which here is closed by a seal 2. On the top this seal 2 has a cupola-shaped lid 29, beneath which the actual pushbutton of the dispenser is concealed. Toward the front, the seal 2 extends into a covering 30 of pouring channel 15, and at the very front on this covering 30, a covering cap 27 is shaped, which closes the mouth of pouring channel 15. On the opposite side of the seal 2, a seal tab 28 is shown, which has available at least one material bridge 33 with a designated breaking point. During production, this seal 2 is cushioned onto the attachment 4 beneath, and after the parts have cooled, this seal 2 can be removed easily by breaking the designated breaking points on the material bridge 33 from head 1. Therefore, it provides a reliable initial-opening seal and prevents any contaminating pieces or foreign bodies from getting into the outlet channel, before the purchaser removes this seal 2 for the first time. The attachment 4 on its one side forms the actual pouring channel 15 with a mouth 13, thus a channel that leads from the interior outwards. As can be perceived, on both sides this attachment 4 has a narrow-waisted shape. Thus the attachment 4 can easily be grasped from above by being enclosed by two flexed fingers, such as the index and middle fingers of one hand. Therefore, a bottle equipped with this pushbutton dispenser can be comfortable held by two fingers.

Below attachment 4, there adjoins a screw-on coupling 7, by means of which the pushbutton dispenser can be screwed onto a glass or PET bottle. For this, on its inner side, the screw-on coupling 7 has an appropriate threading, preferably a threading for the widened 28-mm neck of PET bottles. Understandable, other sizes of threadings are also possible. From below, the upper end part 12 of the adjoining conical flow-through channel 9 is inserted into the screw-on coupling 7. At the lower end of this conical flow-through channel 9 is a crimper 21 for suction tube 10. This crimper 21 consists of two gripping arms 31, which embrace the outer contour of suction tube 10 with accurate fit, and in its interior the crimper 21 is shaped so that the cross section in the clear of suction tube 10 makes an exact transition into the inner contour of the crimper 21 and ensures a smooth transition. This is important to ensure as laminar a flow as possible and to suppress foaming of the carbonated beverage flowing through.

Figure 3:
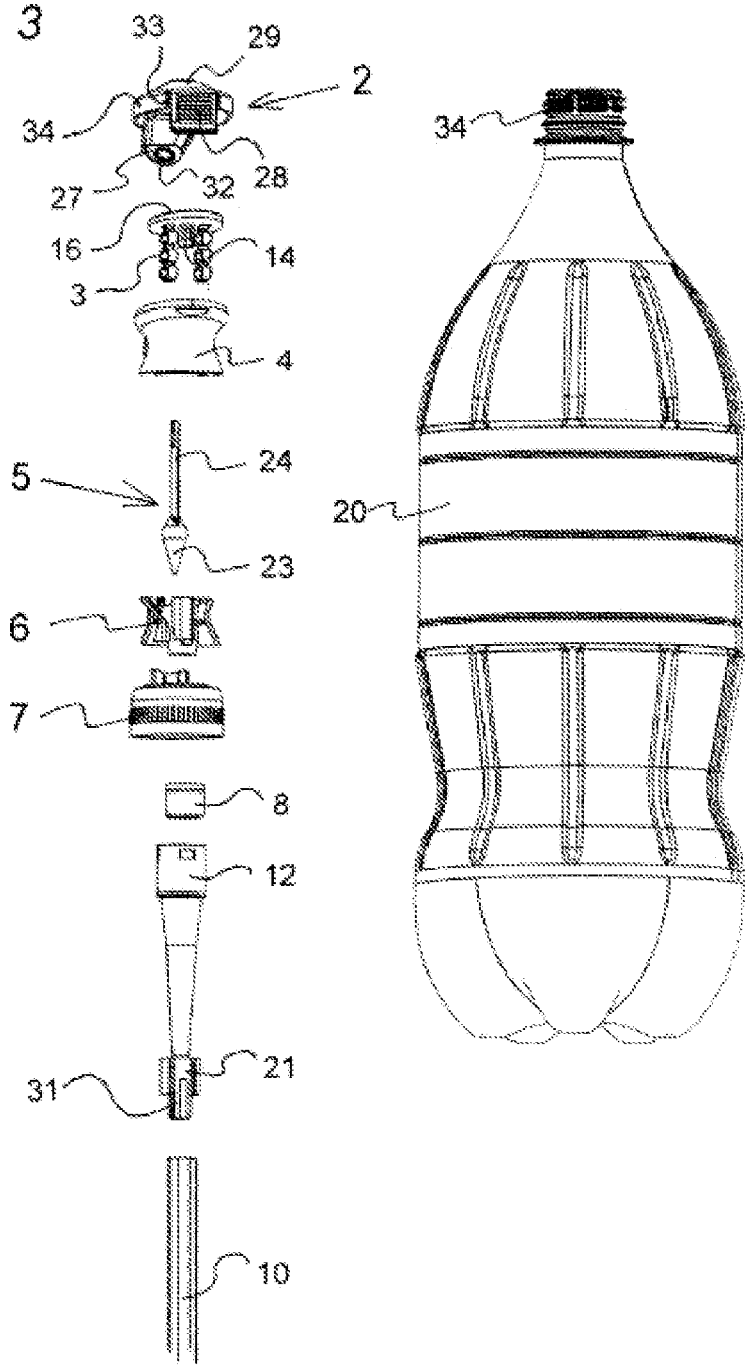

FIG. 3 shows the pushbutton dispenser with all of its component parts in an exploded view. Shown for size comparison to the right is a typical PET bottle 20, which is to be equipped with this pushbutton dispenser. The component parts of the pushbutton dispenser are described from top to bottom. At the very top is the seal 2 with its cupola-shaped lid 29 and its covering cap 27, which on its inner side has a gasket 32 shaped on, which thus comes to sit in sealing fashion in the interior of the mouth 13 of pouring channel 15. Opposite, on the seal 2 is the seal tab 28, which is connected on both sides via thin material bridges 33 with designated breaking points with the surrounding sealing ring 34. Only if this sealing tab 28 is torn off while breaking the material bridges 33, can the seal 2 be removed from the dispenser head 1 and the dispenser is ready to be used.

The next component part seen is the pushbutton 16 of the dispenser. On its underside, two plastic springs 3 are shaped, each in the form of three continuous springy-elastic elements. In the center on the underside of pushbutton 16 a coupling 14 is shaped, into which the regulating means 5 can be snapped, as will be shown. The next component is the attachment 4 for the pouring piece. It is shown here from below and essentially includes this pouring piece 6, which is to be seen below. The attachment 4 is narrow-waisted so that the dispenser can comfortably be grasped with two fingers and carried. The component shown below is the regulating means 5. It is arrow-shaped with a plumb-bob-shaped sealing wedge 23 on its front end, while toward the rear it has a sword-shaped extension 24, with a boat-shaped cross section. The coupling 14 on the underside of pushbutton 16 can be coupled together with the upper end of this extension 24, so that then the regulating means 5 can on the one side be compressed down by pushbutton 16, and on the other side, by force of the compression springs 3 supported below, can again be pushed upward after being let go.

Below the regulating means 5, the pouring piece 6 is seen. This pouring piece 6 for the most part disappears during assembly in the attachment 4 and is encompassed by it. On its front side, not visible here, it forms a pouring channel 15, which is curved in a slight downward arc. The next component is the screw-on coupling 7, by which the dispenser finally is screwed onto the neck threading 34 of the bottle 20 to be equipped. Beneath screw-on coupling 7, the receiving sleeve 8 is shown. In its interior it forms a snug-fit seat for the plumb-bob-shaped sealing wedge 23 of regulating means 5, as will later become clear with the aid of a cross-sectional drawing. With its outer side, this receiving sleeve 8 fits into the upper end part 12 of the conical flow-through channel 9, a plastic tube whose interior widens out from below upwards. On the bottom, this conical flow-through channel 9 exhibits a crimper 21 for suction tube 10, with two gripping arms 31 extending downwards, between which suction tube 10 can be inserted so that a tightly-sealed and smooth transition is achieved of its inner contour into that of the flow-through channel 9.

Figure 4:
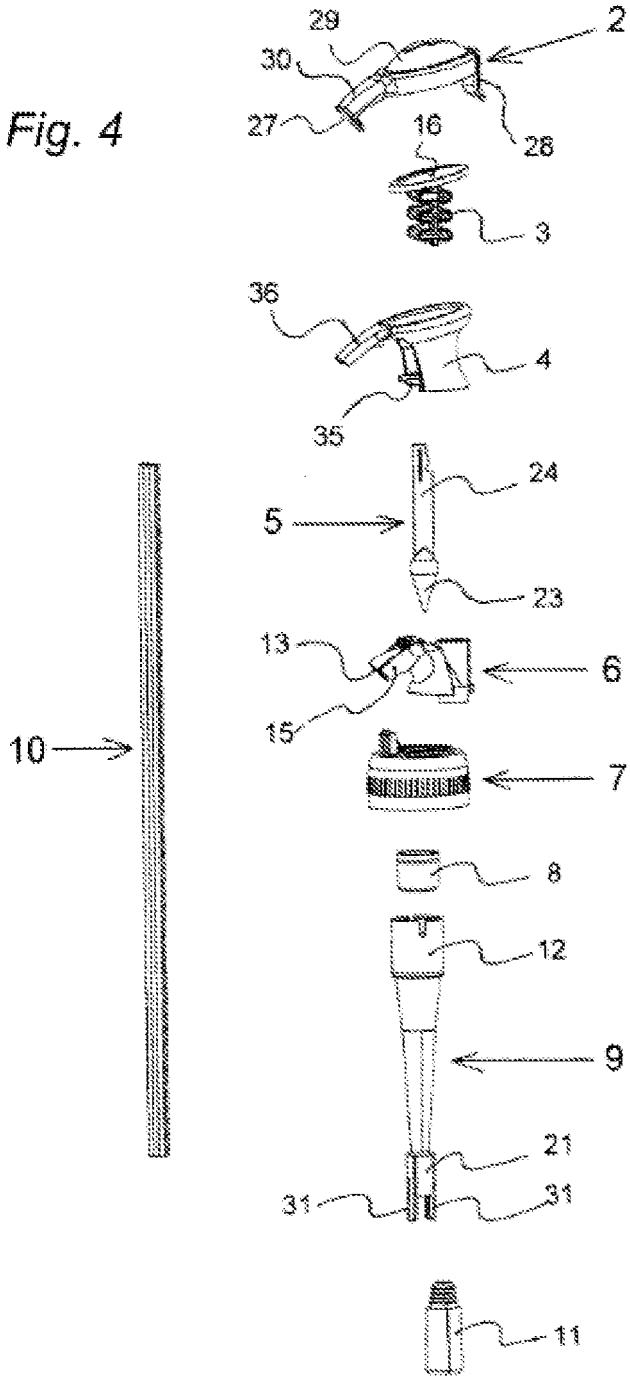

FIG. 4 shows this pushbutton dispenser with all its component parts in another exploded view from a different viewing angle. Again at the very top can be seen the seal 2 with a cupola-shaped lid 29, as well as the cover cap 27 and seal tab 28. Seen beneath it is the pushbutton 16 with the two plastic compression springs 3 shaped on its underside. Then follows the narrow-waisted attachment 4 with the upper covering 36 for the pouring channel. It can be perceived that the upper end of attachment 4 runs at an obtuse angle to the assembly axis. This upper end forms an annular attachment into which pushbutton 16 fits, which then likewise is placed at an obtuse angle to the assembly axis. This obtuse plane is in alignment with the pouring channel, which additionally has a slight downward curving arc, as can be seen by means of the covering 36 of pouring channel 15. Along the lower inner edge of attachment 4 is seen a projection 35 extending inwards, on which, following assembly, the lower ends of the compression springs 3 are braced.

The next component is the arrow-shaped regulating means 5 with a plumb-bob-shaped sealing wedge 23 and sword-shaped extension 24 on its upper side. At the upper end of extension 24, it is shaped so that can be clicked in force-locked fashion into the coupling 14 on the underside of the pushbutton. Next follows the pouring piece 6 with its pouring channel 15 that is bent slightly downwards. This part fits into the upper end of the screw-on coupling 7 that lies below and can be inserted in force-locked fashion onto it. Then follow the already-described parts, namely the receiving sleeve 8, the conical flow-through channel 9 with its crimper 21 for the suction tube 10 shown in the drawing next to the flow-through channel 9, and at the very bottom the mouthpiece 11 to add weight to the mouthpiece area of suction tube 10.

Figure 5:
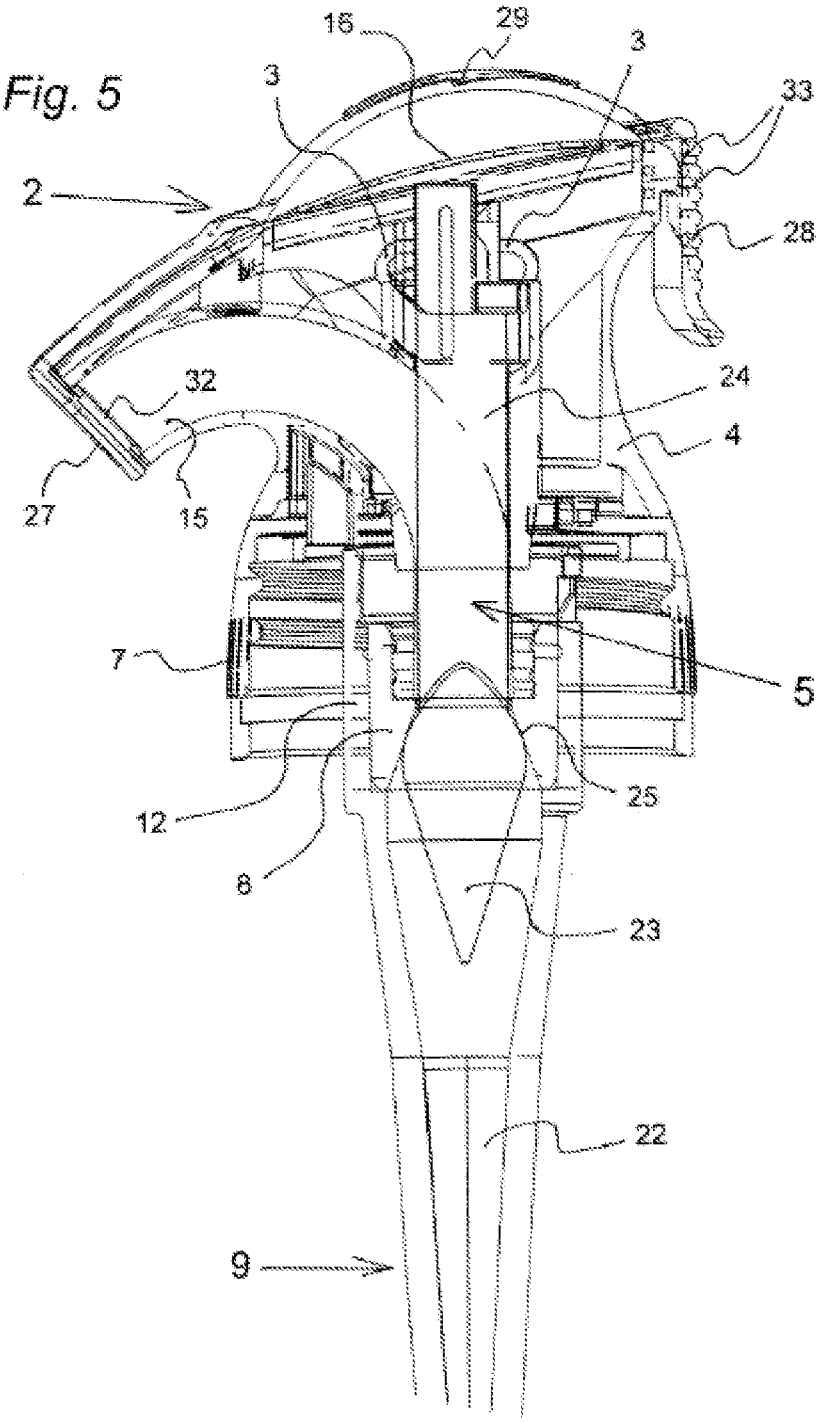

The function of this pushbutton dispenser is described hereinafter in detail with the aid of FIG. 5. This shows the head 1 of the pushbutton dispenser, depicted assembled in a longitudinal cross section. Here it can be perceived how the regulating means 5 is installed. In the upper end area 12 of conical flow-through channel 9, a receiving sleeve 8 is inserted from above. This is manufactured in a 2K injection-molding technique, and on its inner side it exhibits a soft component that acts as a sealing element. During assembly, regulating means 5 is inserted from above through the upper end area of conical flow-through channel 9 and afterwards receiving sleeve 8 is inserted from above. After this, regulating means 5 can no longer be withdrawn upwards, because it is surrounded by receiving sleeve 8. With its inner side, receiving sleeve 8 forms a sealing surface 25 for the shoulder of plumb-bob-shaped sealing wedge 23 of regulating means 5. If, after removal of the seal 2, regulating means 5 is compressed downward by pressing on pushbutton 16, then sealing wedge 23 is lifted off sealing surface 25 downwards, and an annular gap is formed. Immediately by this means, the pressure in conical flow-through channel 9 is reduced, and the liquid flows due to the higher inner pressure in the bottle from below, about sealing wedge 23 and upward around it. Finally the liquid gets through the pouring channel 15 outwards. The governing means 5 acts against the pressure of compressing springs 3, which compress pushbutton 16 upwards and thus also pull regulating means 5 always upwards, so that after pushbutton 16 is released, it returns to its initial position and sealing wedge 23 is again drawn to sealing surface 25. The contents of the bottle are thus prevented from flowing out.

All of this occurs in any position of the bottle, especially in any position between the upright bottle position and a horizontal position. Therefore, the bottle can readily be placed on a refrigerator door or also horizontally on the shelf of the refrigerator. In both instances, liquid can be extracted very simply from the bottle. One merely needs to use one finger to press on pushbutton 16, and the beverage flows in controllable fashion into an offered drinking cup or into a drinking glass. To dispense a beverage, the bottle no longer needs to be taken out of the refrigerator. Therefore, the weight of it from then on is of no importance. One important aspect of this pushbutton dispenser is that it makes possible an approximately uniform pouring out of the bottle's contents over the entire filling level of the bottle, regardless of whether it is upright or horizontal. For this, the design of the suction tube is of great importance. It is deformable, i.e., if the pressure in its interior drops to atmospheric pressure due to pushbutton 16 being pressed, the considerably higher pressure in the bottle from outside acts on suction tube 10. Due to its special geometry, it is elastically compressed inward a little, so that its flow-through channel 17 becomes narrower. Correspondingly, at a high pressure difference of 1 to 2 bar as compared to atmospheric pressure, initially the beverage is dispensed through a narrow cross-sectional opening. The more liquid is removed, the more the interior pressure drops in the bottle, and thus also the differential pressure relative to the atmospheric pressure. Therefore, suction tube 10 is ever less compressed, and the flow-through cross section becomes larger until the bottle is totally emptied, the suction tube 10 is nearly completely de-tensioned and assumes its unloaded shape. Thus, the flow-through cross section increases to the extent that the differential pressure decreases. This trick permits an approximately uniform mass flow when emptying the bottle. At the start, the outward flow velocity is great, but the flow-through cross section is small. Gradually the outward flow velocity is reduced, but the flow-through cross section for this increases.

Figure 6:
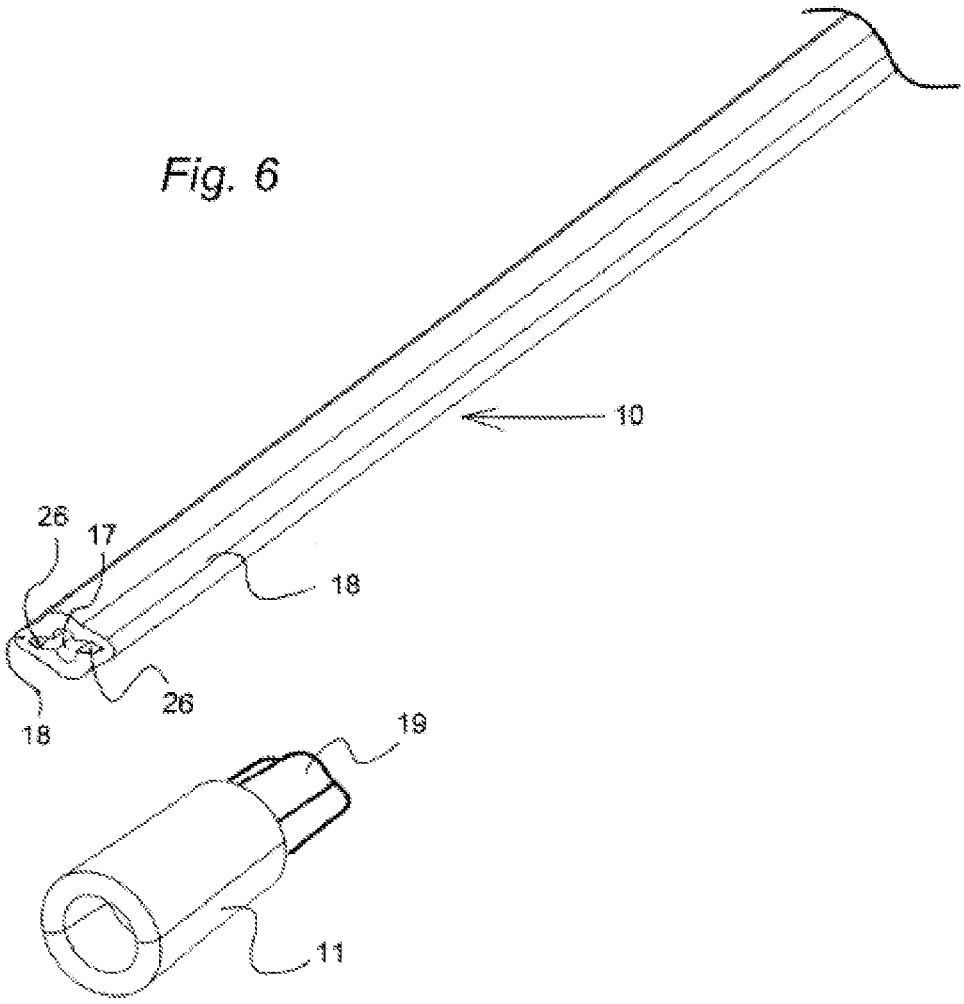

FIG. 6 shows a perspective view of the suction tube 10, with the suction mouthpiece 11 belonging to it. As a particular feature, it can have a cross-sectional shape that is not circular on the outside and which on the inside forms a flow-through channel 17 with an adjoining extension 26 on each side. In the example shown, suction tube 10 on the outside has a round cross-sectional shape, but on both sides the cross section extends out at an acute angle into wings 18, and the inner hollow cross section forms a central flow-through channel 17, with planar extensions 26 adjoining same on both sides, which extend into the wings 18. Alternatively, on the outside it could have an elliptical cross sectional shape, and on the inside form a flow-through channel flattened over the longitudinal direction of the elliptical cross-sectional shape. Such a suction tube is preferably manufactured of a rubber-elastic plastic, for example polyurethane silicon with a Shore C hardness of 40 to 60 and an interior diameter of the central channel of 1.5 mm. Thus, over the entire continuously reducing pressure difference zone, during dispensing, an approximately uniform volume flow of ca. 1.3 to 1.4 l per minute is generated. When the material is harder, with a Shore C-hardness of 85 or more, the suction tube is already behaving like a rigid tube, and the function no longer is guaranteed.

Figure 7:
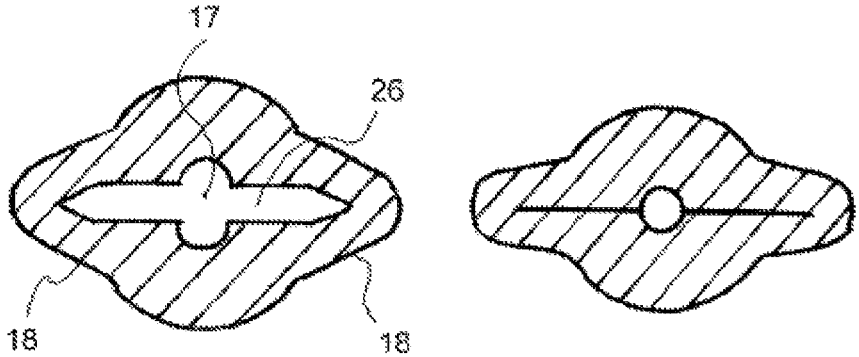

FIG. 7 shows this preferred suction tube cross section at left at a pressure equal inside and outside, as well as at reduced inner pressure to the right. Thus, the suction tube on the outside is not totally circular and on the inside exhibits a flow-through channel 17 with an adjoining extension 26 on each side. It has a round cross-sectional shape, is about 9 mm high and 13.5 mm wide, and on both sides the cross section runs at an acute angle into wings 18 with a rounded 55° tip, and the inner hollow cross section forms a central flow-through channel 17, with flat, 1.3-mm-high extensions 26 adjoining on both sides, which extend 4.5 mm laterally into the wings 18. If the pressure in the interior is reduced by a connection to the atmosphere to its pressure, then the suction tube is compressed together from without, and with a sufficient pressure difference the cross section appears as in the illustration at right. Only the central channel 17 remains open, while the two extensions 26 at left and right are closed. Correspondingly, the flow-through cross section is reduced. If the pressure difference, due to the gradually sinking inner pressure in the bottle decreases, the extensions 26 open up by the width of a slit, and then if the pressure difference continues to drop, constantly more so that gradually the entire flow-through cross section becomes free as shown in the left drawing. However, the effective flow-through rate remains similarly large over the entire pressure drop. Ideally it is 1.3 to 1.4 l per minute.

Figure 8:
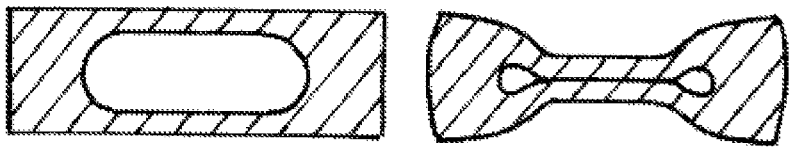

FIG. 8 shows an alternative suction tube cross section at equal interior and exterior pressure as well as with reduced interior pressure at the right. Here the suction tube has a simple rectangular cross section with a flattened flow-through channel on the inner side with semicircular side walls. At high exterior pressure and low interior pressure, the suction tube is compressed totally together in its center section as shown at the right of the illustration, and two flow-through passages are formed with a flow-through cross section severely reduced overall. As exterior pressure is reduced, the suction tube gradually opens up until the de-tensioned situation at the left is reached.

Figure 9:
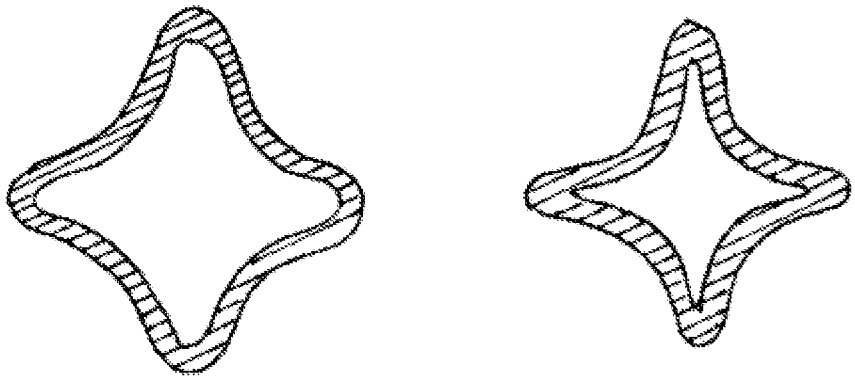

FIG. 9 depicts a suction tube with a star-shaped cross section where interior and exterior pressure are equal, as well as with reduced interior pressure at the right. Here the higher exterior pressure causes a squeezing together of the star-shaped projecting wings, so that at maximum exterior pressure, only a roughly rhombus-shaped central cross section remains free as a flow-through channel.

Figure 10:
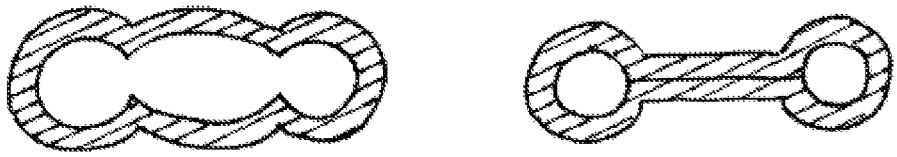
Figure 11:
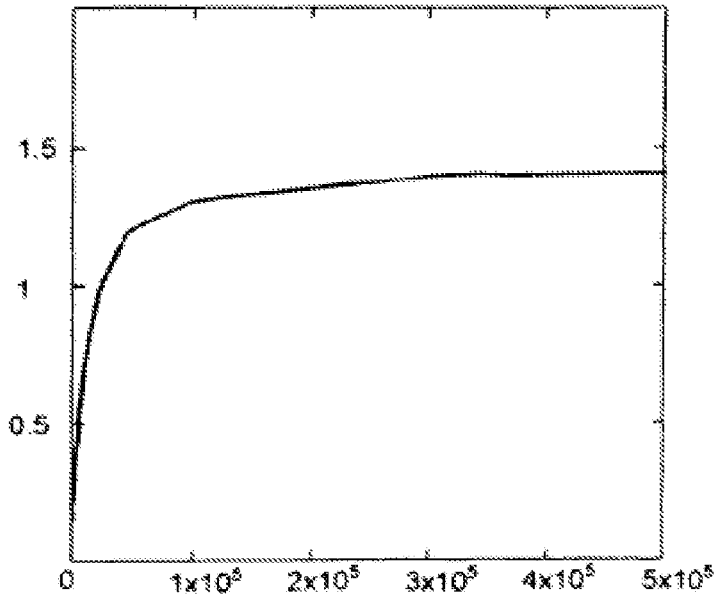

FIG. 10 shows a dumbbell-shaped suction tube cross section with equal interior and exterior pressure as well as with reduced interior pressure at the right. Here the higher exterior pressure causes a complete squeezing together of the middle section of this suction tube, with a small circular flow-through channel remaining open to both sides of it. If the exterior pressure is reduced, the middle section gradually opens until a de-tensioned state is reached, which is shown in the illustration at the left.

As a result of the purposefully chosen geometry of such a suction tube, a flow-through rate is generated that remains roughly constant over an entire range of a pressure differential of, for example, $10^5$ Pa to $5\times10^5$ Pa, namely between 1.3 and 1.4 l per minute. This behavior is depicted in the FIG. 11 diagram.

The suction tube 10 made of rubber-elastic plastic nonetheless possesses a certain stiffness, so that it would bend only a little downwards in a horizontal bottle from the central axis of the bottle. So that, despite this, the entire contents can be extracted due to the prevailing interior pressure, at its lower end the suction tube 10 is equipped with a mouthpiece 11. This has a density between 2.8 and 3.2 g/ml and is inserted from below onto suction tube 10, so that if the bottle is horizontal, the suction mouth of suction tube 10 comes to rest at the deepest point in the bottle's interior due to the weight of this mouthpiece 11. For this, the mouthpiece 11 is manufactured, for example, from a thermoplastic polybutylenterephthalate PBT, and enriched and diluted with rock flour, to attain this high density and a correspondingly great weight.

In addition to the pouring function that is satisfying purely in technical terms, this pushbutton dispenser has still other advantages. Due to the special configuration of the pouring channel from mouthpiece 11, namely due to the conical expansion in the attachment to suction tube 10, the outlet flow is decelerated, which substantially suppresses foaming. After flowing around sealing wedge 23, the liquid follows for a distance along the sword-shaped extension of regulating means 5. Only then does it come to the actual pouring channel 15 and then, unpressurized, it flows out of it. Tests have shown that a bottle with this pushbutton dispenser can be emptied to where the residue is only a few drops, with little foaming.

Because this pushbutton dispenser consists of an extraordinarily low number of component parts, it can be manufactured in cost-effective fashion and is simple to assemble, which makes it an ideal mass-produced product. Due to its consisting exclusively of plastic parts, it is also a one-time-use dispenser, all the parts of which can be recycled or burned. It even offers an initial-opening seal and permits a bottle thus equipped to be carried about comfortably, suspended between two flexed fingers.

LIST OF REFERENCE NUMBERS

1 Head
2 Seal

3 Compression spring
4 Attachment for pouring piece
5 Regulating means
6 pouring piece
7 screw-on coupling
8 receiving sleeve
9 conical flow-through channel
10 suction tube
11 mouthpiece
12 upper end area, flow-through channel 9
13 mouth of pouring channel 15
14 lower coupling on pushbutton 16
15 pouring channel
16 pushbutton
17 inner flow-through channel in suction tube
18 wing on suction tube
19 insertion coupling on suction mouthpiece
20 bottle
21 crimper
22 inner cross section of conically widening flow-through channel 9
23 sealing wedge of regulating means
24 sword-shaped extension on regulating means
25 sealing surface
26 extension on inner flow-through channel 17
27 cover cap of seal
28 seal tab of seal
29 cupola-shaped lid on seal
30 covering on seal for pouring channel 15
31 gripping arms on clamping seal for suction tube
32 sealing ring on cover cap 27 on seal 2
33 material bridges with designated breaking points of seal tab 28
34 threading neck of bottle 20
35 projection extending inwards on attachment 4
36 covering on the attachment, for pouring channel 15

The invention claimed is:

1. A pushbutton dispenser for bottles with carbonated beverages comprising a head (1) able to be screwed onto a bottle with a lateral pouring channel (15), a pushbutton (16) on its top, and a suction tube (10) projecting downwards, which is meant to reach down to the bottom of the bottle (20) to be equipped, and which opens out at the top into a valve device in the head (1), which exhibits a regulating means (5) able to be moved axially relative to the bottle (20), which is acted upon by a spring (3) in the closing direction, and is able to be acted upon for opening from above manually with a pressing on the pushbutton (16), so that the pressure in the interior of the suction tube (10) is able to be reduced to the ambient pressure, through which liquid can be expelled from the bottle (20) through the inner pressure prevailing in the bottle (20) from the lower mouth of the suction tube (10) via the pouring channel (15), characterized in that the suction tube (10) is manufactured from a elastomeric plastic, and its outer and inner cross sections are so configured that with an inner pressure reduced to the ambient pressure it can be made narrow by deformation in its flow-through cross section in relation to the increased pressure prevailing from outside.

2. The pushbutton dispenser for bottles with carbonated beverages according to claim 1, characterized in that the suction tube (10) exhibits a cross-sectional shape that is not circular on its exterior, and on its interior forms a flow-through channel (17) with adjoining flat projections (26) on each side.

3. The pushbutton dispenser for bottles with carbonated beverages according to claim 1, characterized in that the suction tube (10) has an exterior round cross-sectional form with a radius of 4.5 mm, but which additionally on the exterior extends out on two opposite sides into a projecting wing (18), so that its overall width is 13.5 mm, and that the interior hollow cross section forms a central flow-through channel (17) with adjoining flat extensions (26) on both sides of same, which extend into the wings (18), with the central flow-through channel (17) measuring 1.5 mm in interior diameter when the extensions (26) are compressed together.

4. The pushbutton dispenser for bottles with carbonated beverages according to claim 1, characterized in that the suction tube (10) has an exterior rectangular cross-sectional form, and on the interior a flattened flow-through channel (17) with semicircular side walls, so that when the interior pressure is reduced to ambient pressure, it can be narrowed by deformation in its flow-through cross section relative to the increased prevailing exterior pressure, in that the flow-through channel (17) in the center can be totally squeezed together, so that a flow-through channel remains only on each of its two sides.

5. The pushbutton dispenser for bottles with carbonated beverages according to claim 1, characterized in that the suction tube (10) has an exterior elliptical cross-sectional form, and on the interior forms a flattened flow-through channel over the longitudinal direction of the elliptical cross-sectional form.

6. The pushbutton dispenser for bottles with carbonated beverages according to claim 1, characterized in that the suction tube (10) has a dumbbell-shaped cross section with an interior flow-through channel running approximately over the entire width, so that with an exterior pressure that is increased relative to the interior pressure, it is totally squeezed together in the center area and remains open only in the two edge areas of the flow-through channel.

7. The pushbutton dispenser for bottles with carbonated beverages according to claim 1, characterized in that the suction tube (10) is manufactured from polyurethane silicon with a Shore C-hardness of 40 to 60.

8. The pushbutton dispenser for bottles with carbonated beverages according to claim 1, characterized in that the suction tube (10) extends in sealing fashion with its upper end into a crimper (21), into which its flow-through channel is admitted with accurate fit, and thereafter makes a transition into a conically expanding flow-through channel (9) with an approximately equal or equal inner cross-sectional form (22), with this flow-through channel (9) forming an end area (12) above, into which a receiving sleeve (8) molded in a 2K injection-molding technique with a sealing surface (25) injection molded onto the interior is inserted, through which the regulating means (5) extends, which consists of a plumb-bob-shaped sealing wedge (23) with a sword-shaped projection (24) extending upwards, with the sealing wedge (23) adjoining below with its shoulder on the sealing surface (25) in that its sword-shaped projection (24) on its upper end is drawn upward by the pushbutton (16) by force of the compression springs (3), and with the regulating means (5) acting manually from above by pressure the sealing wedge (23) is able to be lifted away from the sealing surface (25) downwards against the force of the compression springs (3), so that the liquid expelled from the suction tube (10) flows about the sealing wedge (23) on all sides and thereafter flows along the sword-shaped extension (24) and outwards via the pouring channel (15).

9. The pushbutton dispenser for bottles with carbonated beverages according to claim 1, characterized in that the head (1) able to be screwed onto a bottle consists of an attachment (4) for slipping over the pouring piece (6) with guidance for the regulating means (5), and that the compression spring (3)

is a plastic spring injection-molded from multiple tensile-elastic elements, which can be coupled together in force-locked form with the underside of the pushbutton (16) which is placed above in the attachment (4).

10. The pushbutton dispenser for bottles with carbonated beverages according to claim 1, characterized in that the head (1) exhibits an attachment (4) which is laterally shaped with a narrowed waist, so that it can be grasped with the index finger and middle finger of one hand from above and thus a bottle (20) equipped with the pushbutton dispenser can be carried by two fingers.

11. The pushbutton dispenser for bottles with carbonated beverages according to claim 1, characterized in that the head (1) exhibits an attachment (4) to admit the pushbutton (16), and at the top the attachment (4) forms a ring that lies at an oblique angle to the movement direction of the governing means (5), which surrounds the inserted pushbutton (16), and which ring, from its lowest point, extends out in an arc-like covering (36) bent downwards for the pouring channel (15), and further that a related seal (2) is able to be clicked from above onto the attachment (4) and its curved covering (30), with this seal (2) forming a cover cap (27) for the mouth (13) of the pouring channel (15), and on its opposite side the seal (2) exhibits a seal tab (28) projecting downwards via material bridges (33) with designated breaking points, which, when the seal (2) is installed, can impact the attachment (4) and can be removed only upon breaking its designated braking points with the seal (2).

12. The pushbutton dispenser for bottles with carbonated beverages according to claim 1, characterized in that onto the lower mouth of the suction tube (10) a mouthpiece (11) is placed with a density between 2.8 and 3.2 g/ml is placed, so that for a horizontal bottle equipped with the pushbutton dispenser, the suction mouth of the suction tube (10) comes to rest on the lowest point of the bottle interior due to the weight of the mouthpiece (11).

13. The pushbutton dispenser for bottles with carbonated beverages according to claim 1, characterized in that onto the lower mouth of the suction tube (10) a mouthpiece (11) is placed with a density between 2.8 and 3.2 g/ml, so that for a horizontal bottle equipped with the pushbutton dispenser, the suction mouth of the suction tube (10) comes to rest on the lowest point of the bottle interior due to the weight of the mouthpiece (11), and that this mouthpiece (11) consists of a thermoplastic polybutylenterephthalate PBT, diluted with rock flour.

* * * * *